US005357489A

United States Patent [19]

Luthier

[11] Patent Number: 5,357,489

[45] Date of Patent: Oct. 18, 1994

[54] TIMEPIECE PROVIDED WITH DRIVING MEANS FORMED BY A PIEZO-ELECTRIC MOTOR

[75] Inventor: Roland Luthier, St-Sulpice, Switzerland

[73] Assignee: Asulab S.A., Bienne, Switzerland

[21] Appl. No.: 117,808

[22] Filed: Sep. 8, 1993

[30] Foreign Application Priority Data

Sep. 9, 1992 [CH] Switzerland ..... 2845/92-8

[51] Int. Cl.[5] ..... G04B 19/20; G04F 5/00

[52] U.S. Cl. ..... 368/37; 368/157; 310/323

[58] Field of Search ..... 368/28, 35, 37, 76, 368/80, 155–157, 160, 255; 310/316, 317, 321–323

[56] References Cited

U.S. PATENT DOCUMENTS

| | | | |
|---|---|---|---|
| 3,726,080 | 4/1991 | Vosseller | 58/23 |
| 4,786,836 | 11/1988 | Tokushima | 310/323 |
| 5,023,853 | 6/1991 | Kawata et al. | 368/230 |
| 5,043,956 | 8/1991 | Tsukada et al. | 368/255 |

FOREIGN PATENT DOCUMENTS

| | | |
|---|---|---|
| 0424140 | 4/1991 | European Pat. Off. . |
| 2059743 | 6/1971 | France . |

OTHER PUBLICATIONS

Patent Abstracts of Japan; vol. 9, No. 262 (P-398) (1985) 19 Oct. 1985 and JP-A-60 111 178 (Suwa Seikosha K.K.) 17 Jun. 1985.

Patent Abstracts of Japan; vol. 12, No. 334 (P-756) 8 Sep. 1988 and JP-A-63 096 591 (Seiko Epson Corp.) 27 Apr. 1988.

Patent Abstracts of Japan; vol. 11, No. 354 (P-638) 19 Nov. 1987 and JP-A-62 133 379 (Seiko Epson Corp.) 16 Jun. 1987.

*Primary Examiner*—Vit W. Miska

*Attorney, Agent, or Firm*—Griffin Butler Whisenhunt & Kurtossy

[57] ABSTRACT

A timepiece comprising a display (2) such as a data display and a driving motor (M1, M2) for driving the display is characterized in that the driving motor comprises a piezo-electric motor directly engaging the display.

19 Claims, 7 Drawing Sheets

TIMEPIECE PROVIDED WITH DRIVING MEANS FORMED BY A PIEZO-ELECTRIC MOTOR

FIELD OF THE INVENTION

The present invention concerns a timepiece provided with driving means formed by a piezo-electric motor.

More specifically, such invention concerns a timepiece including a date display driven by a piezo-electric motor.

BACKGROUND OF THE INVENTION

In known timepieces, the date display is formed by a disc, generally toothed on the interior, which moves facing an opening and which is driven over a 24 hour period by a reducing gear wheel train, itself operated via the dial train by an electromagnetic motor of the stepping motor type having a bipolar magnet.

This type of drive thus requires the arrangement of a special wheel train meshing with the dial train. Such wheel train generally includes at least one specific driving wheel which is provided, on the one hand, with standard outer teeth receiving a motor couple from said dial train and which, on the other hand, is provided with an elastic arm which engages with the date disc.

Such arm is adapted so as to be able to absorb rapid displacements forward or backward from the date disc during rapid correction effected by the user through the time setting crown.

Otherwise, in addition to such first driving means which enable normal displacement of the date disc, such arrangement requires having available other driving means formed by a special correction mechanism including, for example, a sliding pinion cooperating with an intermediate wheel capable of bringing about the rapid correction mentioned hereinabove with the help of the crown.

Such arrangement is thus complex, clumsy and costly.

Furthermore, it is relatively fragile being given that certain manipulations such as rapid correction and correction via the dial train in the neighbourhood of midnight can abnormally stress and damage the elastic arm of the driving wheel operating the date disc.

Otherwise, since it is driven in rotation in a permanent manner by the dial train, the wheel train of the first driving means creates a substantial resistive load on the dial train, even though the date disc need be displaced in normal operation only once every twenty-four hours.

Furthermore, the data disc must be perfectly positioned relative to the opening following each displacement so that the disc generally cooperates with a jumper spring which increases in a significant manner the resistive couple.

Thus, the present invention has as purpose to overcome these drawbacks in furnishing a timepiece including display means such as a date display operated by driving means permitting the simplification of the overall conception of such timepiece by diminishing the number of its components, its dimensions and the applied load.

SUMMARY OF THE INVENTION

An object of the present invention is to provide a timepiece comprising

- display means, and
- driving means intended to operate said display means, the timepiece being characterized in that said driving means include a piezo-electric motor engaging directly with said display means.

It will also be specified that such piezo-electric motor, which comprises a stator and a rotor, includes angular indexing means integrated with said rotor and adapted to stop the rotational movement of the rotor in at least one predetermined angular position.

Otherwise, said indexing means include a rigid hub which exhibits a cam profile on which an elastic contact blade is brought to rest laterally.

According to another characteristic of the invention, said blade cooperates with an electric position detection circuit which it opens at a predetermined angular position of the rotor.

It will be further specified that said blade is mounted on a support driven into a base plate or a bridge with interposition of an electric insulator.

Other characteristics and advantages of the invention will appear upon reading the detailed description which follows, having reference to the attached drawings which are given solely by way of example.

BRIEF DESCRIPTION OF THE DRAWINGS

FIGS. 9 and 10 are diagrams showing the amplitude variation curves of the stator deformation in its first vibration mode as a function respectively of the radius on the stator and of an angular position on the latter;

FIG. 11 is a half-view in cross-section similar to FIG. 8, but showing a second mode of vibratory motion of the driving means according to the invention, and FIGS. 12 an 3 are respectively views similar to those of FIGS. 9 and 10, but showing amplitude variation curves of the stator when it is set into vibration according to the vibratory mode of FIG. 11.

DESCRIPTION OF THE PREFERRED EMBODIMENTS

Figure 1:
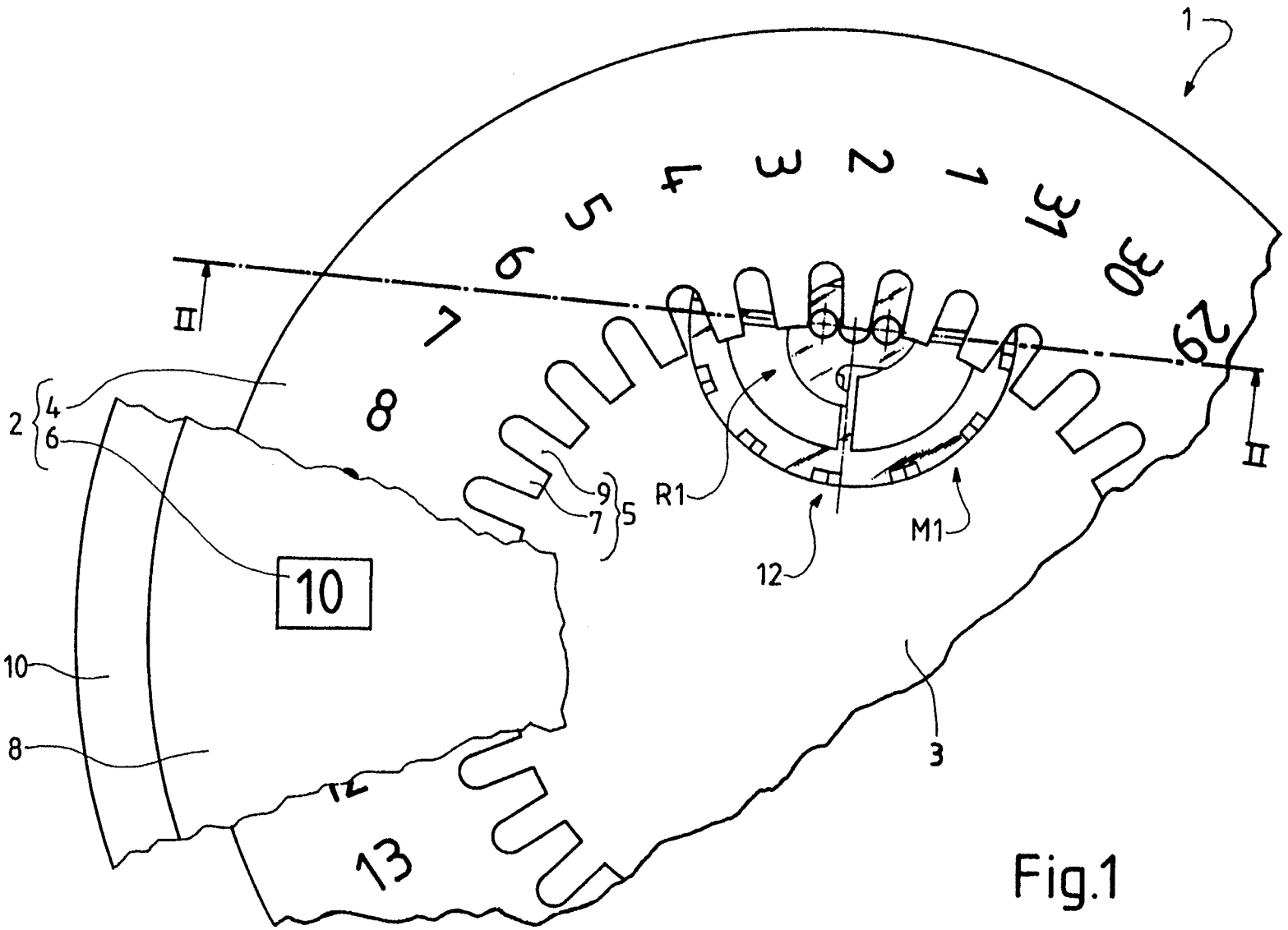
FIG. 1 is a schematic view from above of a timepiece according to the invention showing basically a date disc coupled to driving means according to the invention.

In referring to FIG. 1, there will be described hereinafter a timepiece according to the invention identified by the general reference 1.

Timepiece 1, which is shown on such figure in a very schematic manner, includes display means, here constituted by a date display 2. Timepiece 1 can include other known means of display, not shown, such as an hours and minutes display, a seconds display and a day display which can possibly be associated with still other display means for time or other information without any particular limit.

The display means 2 are constituted in a known manner by an annular disc 4 toothed on the interior, referred to as the date disc, centered by standard means, not shown, and adapted to be displaced opposite an opening 6 formed in a dial 8 which is for example fixed to a case 10 (such two elements being here partially shown in a broken-away manner).

The date display disc 4 includes interior teeth 5 made up of teeth 7 (a single one being referenced) spaced apart from one another by oblong slots 9 having parallel sides.

Timepiece 1 further includes driving means 12 which cooperate directly with the display means 2 and more specifically with the interior teeth 5 and which operate on them in order to assure their displacement in rotation.

The driving means 12 which are arranged basically under disc 4 include a piezo-electric motor shown more specifically according to a first embodiment on FIGS. 2 to 5.

Such motor which is identified by the general reference M1 is hung on a support (FIG. 2) which is, in this example, constituted by a footing 3 formed by a base plate of the timepiece 1, partially shown.

Motor M1 includes a rotor R1 mounted for rotation about a geometric axis X1 on a stator S1 which in its case is fixedly assembled by force fitting (driving) or by gluing in support . Such stator S1 which is thus embedded in footing 3 forms a bearing structure assuring axial support and centering in rotation for rotor R1.

Such bearing structure is essentially constituted by an annular suspended plate P1 fixedly maintained in the footing 3.

On one face F1 of stator S1 arranged facing the footing 3 are mounted piezo-electric means 16 constituted, on the one hand, of a piezo-electric element **16*a* such as a ceramic uniformly polarized over its thickness and, on the other hand, two electrodes 16*b* and 16*c*** which are coupled in a known manner to an electric source AL here shown in schematic fashion.

The piezo-electric means 16 form a transducer which, in response to an electric excitation furnished by the source AL via electrodes **16*b* and 16*c***, can assume a vibratory motion. Such piezo-electric phenomena as well as the construction and arrangement of such piezo-electric transducers in motors of this type are well known to the person skilled in the art and thus will not be described here in a detailed manner.

Plate P1 is formed on the one hand from a thin elastically deformable disc I 4 under which are mounted, in particular by gluing, the piezo-electric means 16. By way of example, disc 14 exhibits a thin uniform thickness on the order of 0.1 mm ($0.1 \cdot 10^{-3}$ meter).

The plate P1 on the other hand includes a tubular cylindrical pipe 18 projecting from the disc 14 and materially integral with the latter. Pipe 18 is thus fixedly driven by force mounting or by gluing in an orifice (not referenced) of footing 3.

The pipe 18 includes a central open orifice 20 in which is driven a headed smooth cylindrical stud V which axially retains and assures centering in rotation of rotor R1, about axis X1, thanks to two coaxial journals (not referenced) arranged on such stud.

To this effect, rotor R1, which rests elastically in axial support on face F2 of disc 14 opposite to the face F1 includes a staged tubular hub 22 of rigid structure mounted to rotate about axis X1 directly on stud V.

Hub 22 includes mechanical engagement means formed by two pins 24 driven into hub 22 and projecting axially therefrom on either side of stud V. The two pins 24 are placed on a radial axis X2 of hub 22 passing through the longitudinal axis X1.

Figure 2:
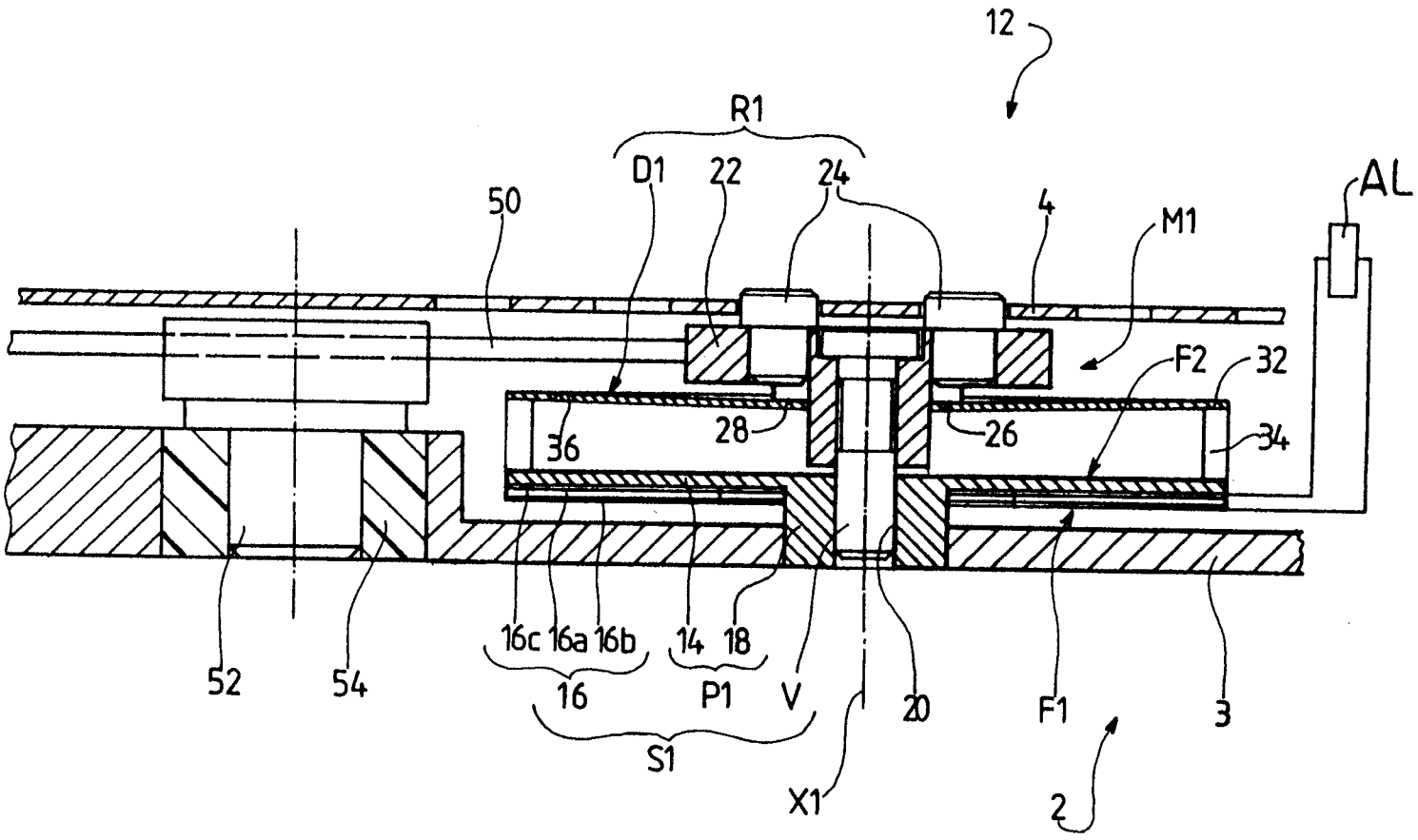
FIG. 2 is a cross-section taken along line II—II of FIG. 1.

Hub 22 furthermore includes thereunder (according to the orientation of motor M1 in its position shown on FIG. 2) a shouldered journal 26 on which is fixedly engaged the body of rotor R1, in particular by driving.

In an advantageous manner, the body of rotor R1 is, according to the invention, basically constituted by a flexible perforated disc D1.

Figure 4:
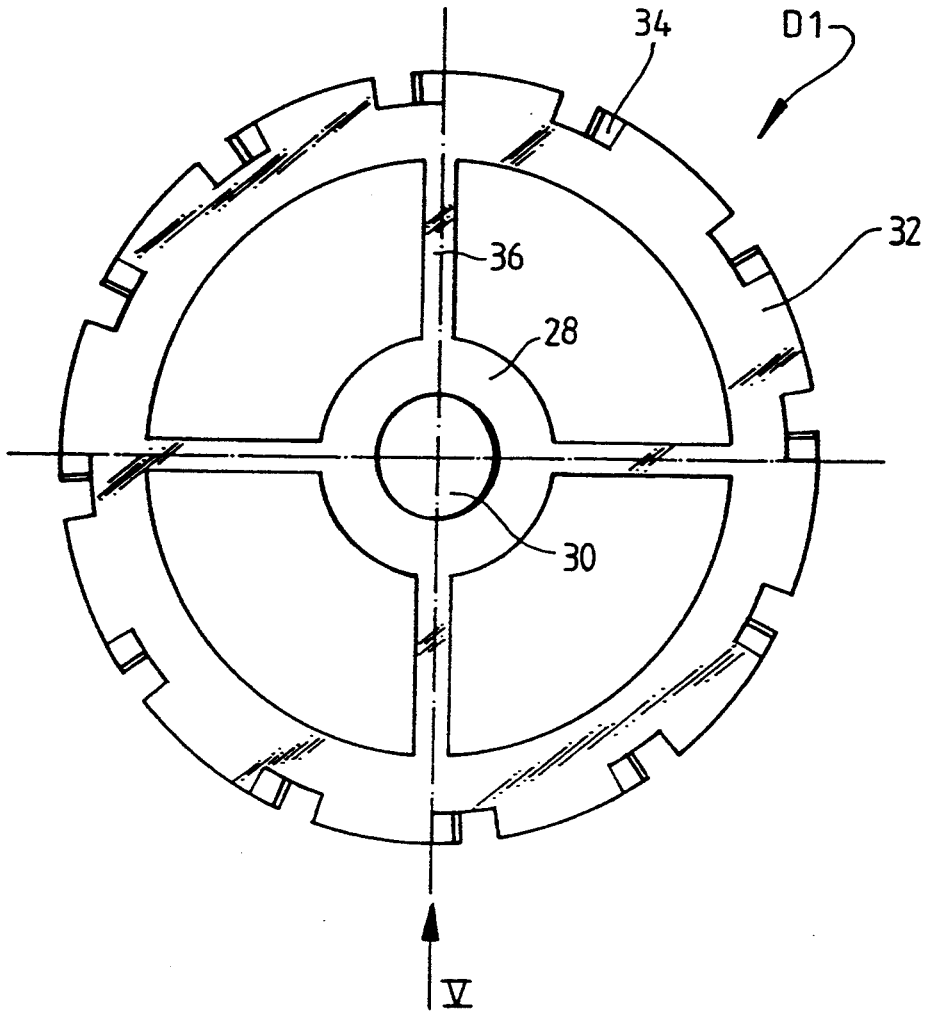
FIG. 4 is a view taken along arrow IV of FIG. 5 showing solely a body and transmission blades of a rotor equipping the driving means according to the invention shown on FIGS. 1 to 3.
Figure 5:
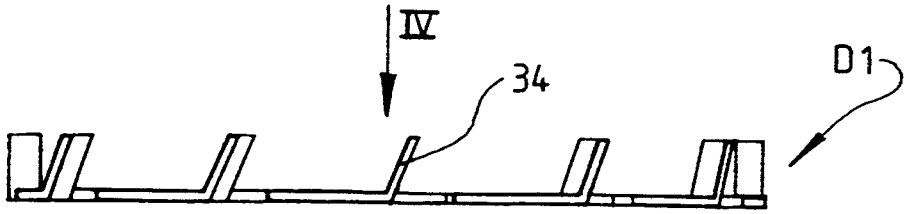
FIG. 5 is a view taken according to arrow V of FIG. 4 and showing from the side and in a rest position the assembly body - blades of FIG. 4.

As is seen more specifically on FIG. 4, disc D1 includes an annular central portion 28 which includes a central opening 30 intended to be brought to engage on journal 26.

Disc D1 otherwise includes a peripheral ring 32 on which are formed motion transmission means adapted to transmit to rotor R1 the vibratory motion of stator S1 and to displace rotor R1 in rotation about its axis X1 in an intermediate displacement plane Pdm (FIG. 7), normal to such axis.

Such transmission means are formed by elastically deformable elements constituted by flexible blades 34 arranged edgewise on disc D1.

In this embodiment, the flexion blades 34 are arranged at the periphery of disc D1 by a cold forming operation and in particular by swaging of the peripheral ring 32.

Furthermore, disc D1 includes flexible arms 36 (for example here four in number, a single one being referenced) which couple elastically the central portion 28 and the peripheral ring 32. The transmission means formed by the flexible blades 34 extending from the peripheral ring 32 towards stator S1, as well as the flexion arms 36, the central portion 28 and ring 32 are materially integral and form a monolithic rotor piece. It will be specified that the peripheral ring 32, the flexible arms 36 and the central portion 28 exhibit the same thickness and are, in the rest state (FIGS. 4 and 5), arranged in a common plane (not referenced).

It is thus understood that the body of rotor R1 is formed by a structure which is elastically deformable, at least in the direction of the stator S1 and which forms, at least partially, elastic support means for rotor R1 on stator S1. Such means are formed as well in part by the hub 22 which urges disc D1 axially towards the stator in an axisymmetric fashion (relative to axis X1) in being retained by the head, not referenced, of the embedded stud V.

It is understood that in other words, the body of rotor R1 is basically formed by the elastically deformable disc D1 which forms in an integrated fashion said transmission means 34 and said elastic support means, not referenced.

As is seen on FIG. 2, in the assembled state and ready to operate, hub 22 deforms permanently the body of rotor R1 which is pre-stressed and which assumes a basin form under the action of stud V. Such placing under stress gives rise to axial bearing and counter-bearing forces on the face F2 of stator S1 and at the free end of blades 34.

Otherwise, it will be specified that electrodes 16b and 16c of the piezo-electric means 16 both exhibit in frontal projection a full solid structure, that is to say, not cut out and not structured by polarized segments as is the case in known structures.

The disc 14 forming stator S1 is preferably obtained from a metallic material such as brass, a stainless steel alloy or aluminium, possibly coated by a thin layer of a hard material, in particular chromium or titanium nitride. Electrodes 16b and 16c are preferably formed from nickel or silver.

Figure 7:
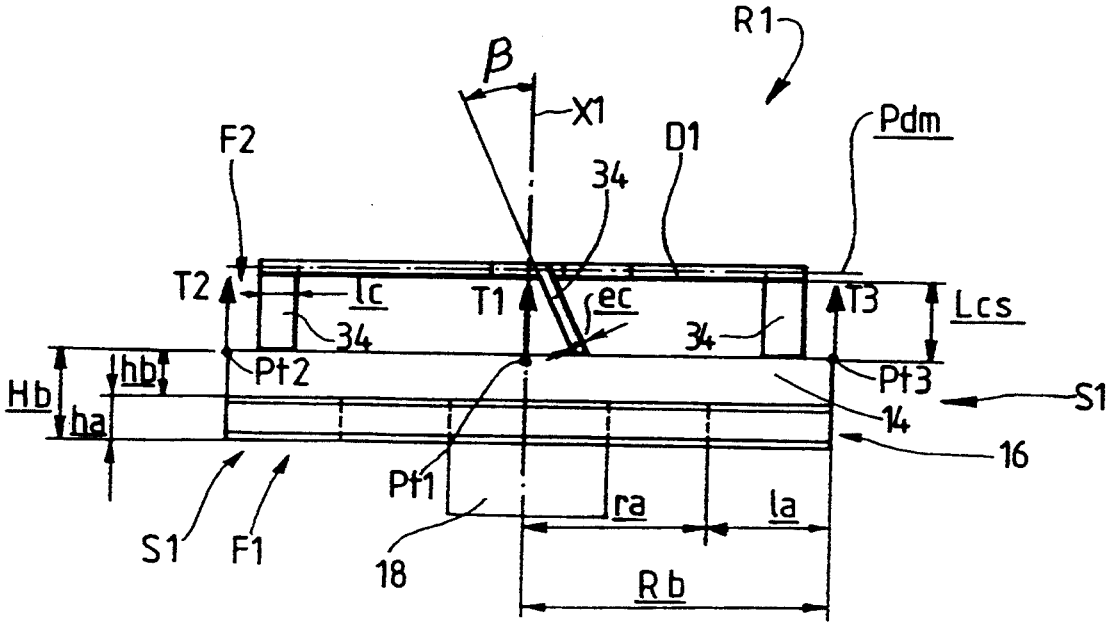
FIG. 7 is a side view solely of the rotor and of a stator of the driving means, in particular of FIG. 2, but shown to a different scale for better understanding of the drawings.

Referring henceforward to FIG. 7, there will be given more specifically some indications concerning the structure of the rotor R1 and stator S1.

The flexion blades 34 (three only here being shown) project from rotor R1 and in particular from disc D1 in the direction of the front face F2 of stator S1 according to an angle of inclination $\beta$ having as origin a line parallel to the rotation axis X1; such angle $\beta$ being comprised between 10° and 30°.

Otherwise, each flexible blade 34 which has a planar form of the parallelepipedon type, projects from rotor R1 over a free length Lcs preferably chosen among values situated between 0.1 and 0.5 mm (0.1 and 0.5 $10^{-3}$ meter). Preferably, each blade 34 exhibits a thickness ec situated between 0.025 and 0.1 mm (0.025 and $0.1 \cdot 10^{-3}$ meter) and a width 1c situated between 0.1 and 0.3 mm (0.1 and 0.3 $\cdot 10^{-3}$ meter). It is noted thus that the flexion blades 34 which in being interposed between rotor R1 and stator S1 form a mechanical interface between the latter, end up and rest directly on the front, basically planar, face F2 of stator S1, such face F2 being smooth and free of any projecting element or protuberance.

The flexible blades 34 and thus disc D1 are formed from a material such as an alloy of the beryllium-copper type or stainless steel type.

Figure 8:
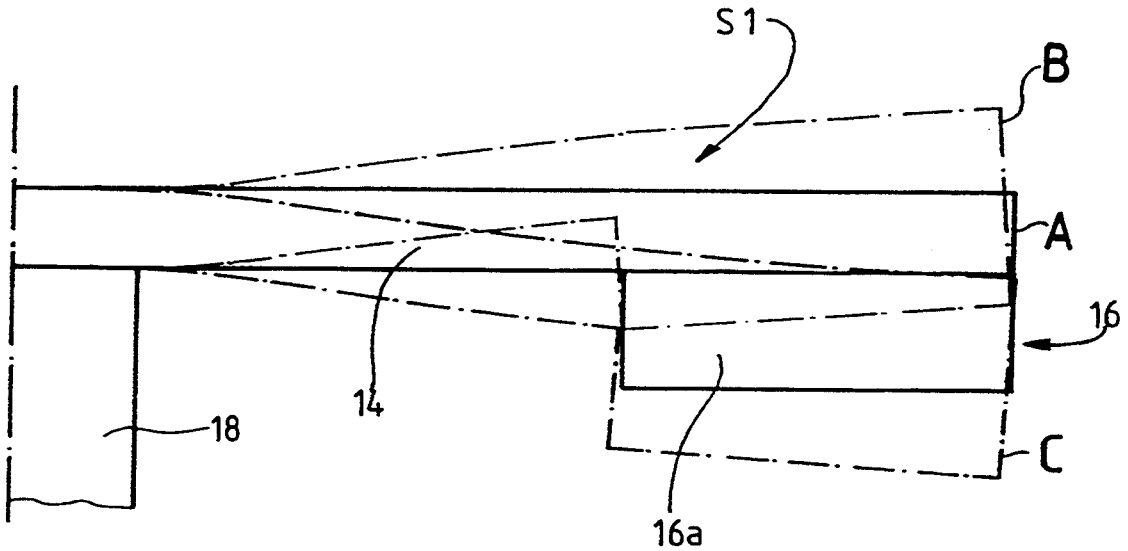
FIG. 8 is a half-view in cross-section of the stator of FIGS. 1 to 3 and 6 and 7 shown in full outline in its rest position and in broken mixed strokes in its two deformed end positions when such stator is excited in vibration according to a first mode of vibratory motion of the driving means according to the invention.
Figure 9:
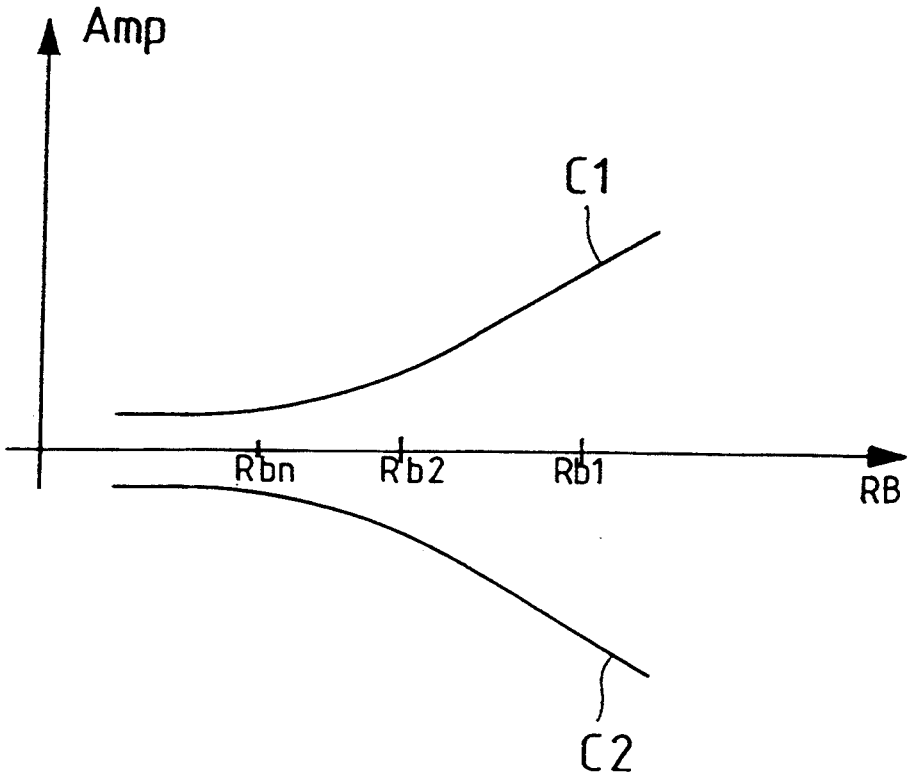

Referring henceforward to FIGS. 8 to 10, there will hereinafter be described a first mode of vibratory motion of the stator according to the invention, given by way of example.

As the half-view in cross-section of stator S1 shown on FIG. 8 clearly shows, stator S1 exhibits a flexible deformation on either side of its rest position identified by reference A. Such deformation is shown in a greatly exaggerated fashion by the respective high B and low C end positions. In reality, such deformation does not exceed a beating amplitude greater than 5 $\mu$m (5 $10^{-6}$ meter), at the periphery of the stator (peak). Such deformation also gives stator S1 a basin form. Such deformation into basin form is due to the flexion stresses generated in stator S1 thanks to the piezo-electric means 16. Such flexible stresses are due to the heterogeneous bimorph structure formed by the rigid assembly of the piezo-electric means 16 on stator S1.

Here it will be specified that in order to obtain the sought-after deformation of stator S1, there is employed a special ceramic adapted to be radially deformed when a specific electric excitation via the electrodes is applied thereto. More specifically, there has been chosen a ceramic exhibiting a high piezo-electric constant $d_{31}$, such constant representing the deformation obtained relative to the applied field.

Such vibratory motion is of the axisymmetric type and furnishes to the stator a deformation of the same type. This is corroborated by the curves C1 and C2 of FIG. 9, where it is noted that the amplitude variation Amp of the stator deformation S1 as a function of its radius Rb is of the same sign, that is to say increasing, from the center towards the periphery of the stator S1.

It is noted that curves C1 and C2 show no point of inflexion nor any passage through a null amplitude value. Such vibratory mode thus will cause no nodal circle to appear on stator S1. Such characteristic is confirmed by curves C3 to Cn (FIG. 10) which show all the amplitude values different from 0 (zero). These curves C3 to Cn show the variations in amplitude of deformation of the stator as a function of the angular position on the latter for different given values of the radius, such variations being measured for a positive amplitude variation corresponding to curve C1 of FIG. 9. Furthermore, it is observed that such curves are straight lines and entirely parallel among themselves, which demonstrates that such vibratory mode does not induce any nodal diameter. One thus has a vibration according to the international standard $B_{nm}$ (n being the number of nodal circles and m the number of nodal diameters) of the type $B_{00}$.

It will also be specified that such vibratory motion and such axisymmetric deformation are centered on the rotation axis X1. There has thus been provided a planar staged motor, that is to say, having a stator and a rotor of a basically planar form and superposed, which motor, thanks to the axisymmetric movement centered on the rotation axis and oriented therealong, is of the type having basically axial vibratory motion with reference to axis X1.

Thanks to these vibratory modes and axisymmetric deformations of very small amplitude, each point, for example Pt1 to Pt3 (FIG. 7) of stator S1 effects a displacement basically parallel to the rotation axis X1 of the same amplitude on a circle inscribed on the rotor at the level of a given radius (for example Rbl to Rbn) and in phase.

The vibration mode of the piezo-electric motor according to the invention being axisymmetric, the velocity vectors T at every point of the stator and in particular in the region of contact between the stator and the rotor (three only, T1 to T3 being shown on FIG. 7) are basically normal to the displacement plane Pdm of rotor R1. Stator S1 thus exhibits no significant velocity component in the displacement plane Pdm in view of the extremely small vibration amplitudes. It thus exhibits no acceleration of the radial, centrifugal or centripetal type which could be significant. It is also noteworthy that such stator does not show any tangential acceleration which acceleration to the contrary is found in the stators of known piezoelectric motors having an advancing or standing wave vibratory mode.

FIG. 11 shows the deformation of stator S1 when it is subjected to a second mode of axisymmetric vibratory motion according to the invention, reference D showing its rest position, while references E and F show the behaviour of the stator in its deformed end positions when it is excited. Such motion this time exhibits a nodal circle, in particular indicated at radius Rb3 (FIGS. 12 and 13). It is noted in effect that curves C1 and C2 of FIG. 12 pass through a null amplitude value marking a vibratory node in the stator. Curves C3 to Cn of FIG. 13 illustrate the axisymmetric character of the vibratory mode and the deformation of stator S1 in showing that for a given radius Rbx of the stator every circle inscribed on the latter exhibits over an angle of 360° a constant amplitude (peak value), curves C3 to Cn of FIG. 13 being straight lines parallel to one another. Such curves C3 to Cn represent the amplitude variations of the stator as a function of the angular positions thereon, such variations being measured for a variation of amplitude corresponding to curve C2 of FIG. 12. Such vibratory mode does not induce any nodal diameter on stator S1. Such vibratory mode is thus of the type $B_{10}$.

In order to obtain such axisymmetric vibratory modes of the type $B_{00}$ and $B_{10}$, there has been generated by means of the electric source AL, an alternating current of frequency F, after having dimensioned, by way of example, the stator and the piezo-electric means in the following manner (having reference to FIG. 7):

| | Mode $B_{00}$ | Mode $B_{10}$ |
|---|---|---|
| | in mm ($10^{-3}$ m) | in mm ($10^{-3}$ m) |
| Hb | 0.2 | 0.2 |
| hb | 0.1 | 0.1 |
| Rb | 2.5 | 2.5 |
| ra | 1 | 1 |
| ha | 0.1 | 0.1 |
| la | 1.5 | 1.5 |
| | in KHz ($10^3$ hertz) | in KHz ($10^3$ hertz) |
| F | 14 | 94 |

where Hb is the overall height of the suspended portion of the stator (disc 14 plus piezo-electric means 16), hb is the height of disc 14, that is to say, the height of the stator without the piezo-electric means 16, Rb is the maximum radius of the stator (taken at the periphery of disc 14), ra is the minor radius of the ring forming the piezo-electric means 16, ha is the overall height of the piezo-electric means 16 (the thickness of the electrodes here being negligible), 1*a* is the width of the piezo-electric means 16 and F is the vibration frequency of stator S1. Disc 14 is in this case constituted by a stainless steel alloy while the piezo-electric element 16*a* is constituted by a piezo-electric ceramic of the type PZT (lead titanate doped with zirconium). Being given that two variants of the axisymmetric vibratory mode have been described here ($B_{00}$ and $B_{10}$), it will be understood that the vibratory mode of the motor according to the invention may be generalized to a notation of the type $B_{xo}$ where x can vary from 0 to a number n.

In operation, the piezo-electric means 16 are excited by the electrical source AL, which causes them to vibrate. The radial component of the vibration of the piezo-electric means 16 generates a flexure vibration of disc 60 by the heterogeneous bimorph principle known to persons skilled in the art.

The electrical source AL furnishes an alternating signal of frequency F corresponding to the resonance frequency of the desired mode $B_{XO}$.

Stator S1 in its entirety is thus excited in resonance in the mode $B_{XO}$ corresponding to an axisymmetric vibratory motion such as has been described hereinbefore.

The deformation in flexion of the stator and thus the displacement of each elementary point on the stator S1 essentially parallel to the rotation axis X1 due to the peak obtained is transformed into a concomitant displacement in rotation of rotor R1 in the displacement plane Pdm, and this thanks to the elastically deformable elements formed by the flexible blades 34. Such elements 34, in being urged, bend and induce velocity components tangential to the periphery of the rotor into rotor R1 and parallel to the displacement plane Pdm of the rotor R1 and located therein.

The elastically deformable elements formed by the flexible blades 34 thus form motion transformation means capable of transmitting and at the same time transforming the basically axial linear (or normal) motion of the stator into a perpendicular rotary motion of the rotor.

In referring again to FIGS. 2 and 3, there will be described hereinafter indexing means (or angular positioning means) adapted to stop the rotational motion of rotor R1 in at least one predetermined angular position. In an advantageous manner, the means which are here described permit stopping motor M1 in two angular positions separated from one another by 180°.

Such indexing means include an elastic contact blade 50 which is arranged in the rotation plane (not referenced) of hub 22 and which is formed to come into lateral contact with the outer circumference of the latter at least during a portion of its rotation.

The elastic contact blade 50 is assembled fixed to the base plate or footing 4 through a support 52 which is driven into the base plate 4 with interposition of a sleeve 54 formed of an electrically insulating material.

Figure 3:
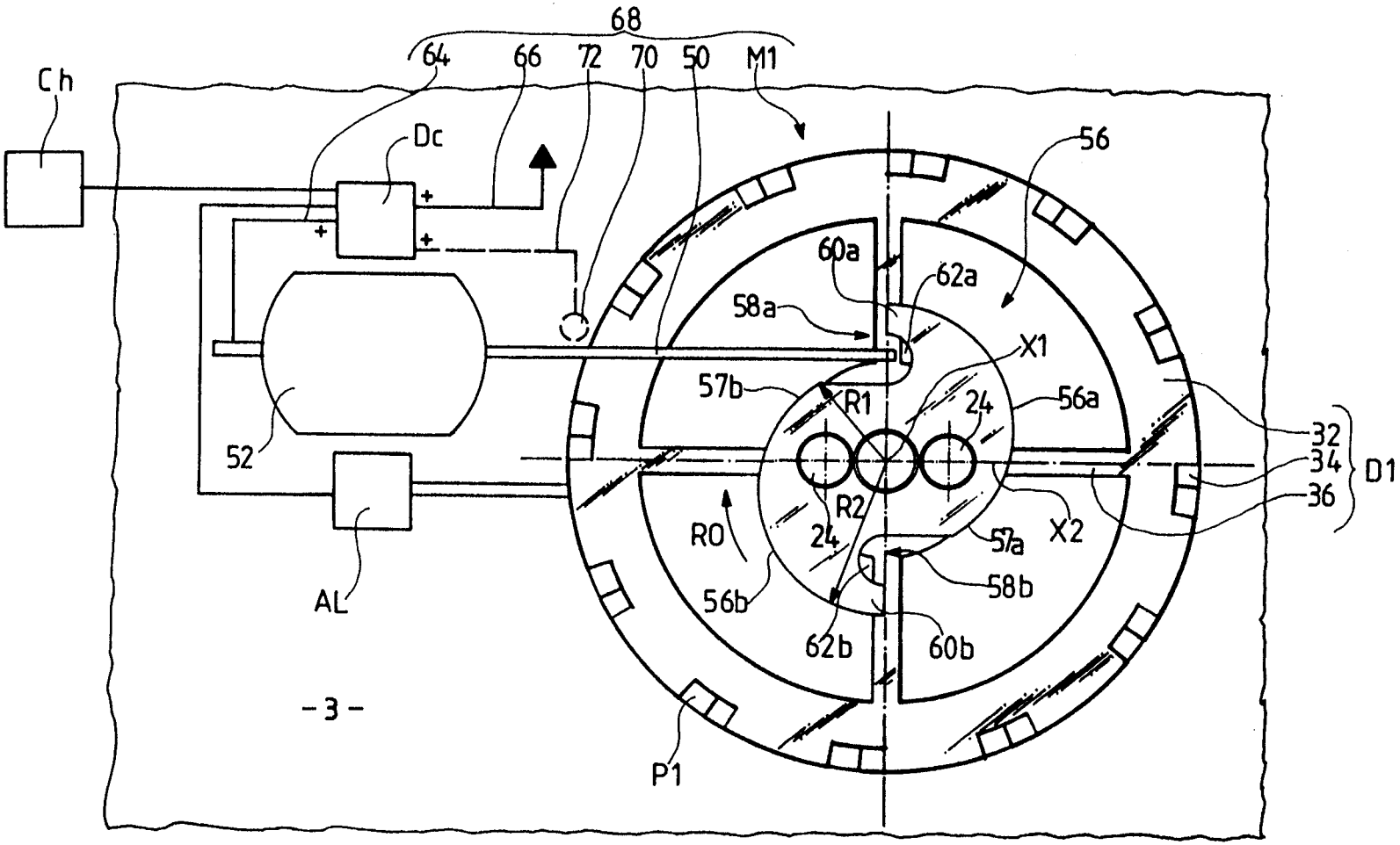
FIG. 3 is a top view of the driving means of FIG. 2, shown without the date disc.

It will be noted in particular on FIG. 3 that the circumference of hub 22 exhibits a cam profile 56 including two characteristic regions 56*a* and 56*b*. The two regions 56*a* and 56*b* exhibit a generally circular arc form and the curves which form them are off-centered relative to one another and respectively relative to axis X1.

The two regions 56*a* and 56*b* which are discontinuous are reunited in an interrupted fashion through two disjunctions respectively 58*a* and 58*b*. At the end of the two regions 56*a* and 56*b* are thus formed respective beaks 60*a* and 60*b*.

In operation, rotor R1, conforming to the principle described hereinbefore, turns in accordance with the rotation sense shown by arrow RO, of the same sign as the rotation sense (not shown) of the date disc 4. In this example, motor M1 and the date disc 4 turn in the clockwise sense.

In taking as reference the rotation sense RO, it is noted that the beaks 60*a* and 60*b* are arranged in the trailing portion of region 56*a* and 56*b*.

Between beak 60*a* and region 56*a* and between beak 60*b* and region 56*b* are respectively arranged disengagements 62*a* and 62*b* of oblong form open towards the exterior and oriented in a manner parallel between themselves and both in a manner parallel to the radial axis X2 of the hub 22 on which are aligned the two engagement pins 24.

More specifically, it is noted that each region 56*a*, 56*b* shows a variable profile the radius of curvature R of which varies progressively from R1 to R2. The leading portions 57*a*, 57*b* of the respective regions 56*a* and 56*b* are arranged relative to axis X1 on a radius R1 smaller than radius R2 of the corresponding beaks 60*a* and 60*b*.

In the rest state and in the two discrete positions of the rotor R1 (a single one being shown on FIG. 3), the free end of the elastic blade 50 is located in one of the disengagements 62*a*, 62*b* and is arranged at a distance from the outer circumference of hub 22. To the contrary, when the source AL furnishes an energization current to stator S1, the leading portion 57*a* or 57*b* arranged facing blade 50 comes into tangential contact with blade 50 which bends initially only slightly. The angular displacement of hub 22 in the rotation sense RO increases the stress applied to blade 50 to arrive at a maximum stress at the level of beak 60*a* or 60*b*. In this fashion, the stress applied to blade 50 is progressively increased and there is applied at the start a relatively small load on the motor.

The elastic contact blade 50 is formed of an electrically conductive material or includes a coating or track (not shown) exhibiting such property.

The timepiece according to the invention includes an electronic control arrangement Dc which is coupled to a watch circuit Ch (here shown in schematic fashion). The arrangement Dc is adapted to be able to control the rotation of motor M1 via electric source AL.

The circuit Ch includes known horometric means which provide the control arrangement Dc with time information such as the passage to the day following at midnight.

Blade 50 is coupled by a first branch of circuit 64 to the electronic control arrangement Dc which is otherwise connected, according to a first embodiment, to a second circuit branch 66, itself coupled for example to base plate 4. Thus, in this embodiment, both circuit branches 64 and 66, blade 50, motor M1 and the base plate 4 form an electric position detecting circuit 68. It is understood that in this embodiment blade 50 and hub 22 constitute within the detection circuit 68 an electromechanical switch.

In a second embodiment likewise shown on FIG. 3, base plate 4 is provided with a conductive stud 70, for example driven thereinto. Stud 70 which is arranged close to blade 50, is coupled to the control arrangement Dc through a circuit branch 72 (shown in interrupted dashes). In such case, hub 22, the motor assembly M1 and/or base plate 4 or parts thereof can be formed of insulating material such as plastic.

Thus, the detection circuit 68 is open in the rest position of the blade shown on FIG. 3, in which position blade 50 in its electrode function is free from all electric contact with the corresponding electrode formed either by rotor R1 itself (hub 22) or by stud 70.

In normal operation and in this specific application, circuit Ch furnishes arrangement Dc, in particular close to midnight, time information in the form of a digital signal called the date signal. The control arrangement Dc then delivers a control signal to the source A1 which energizes electrically the piezo-electric means **16*a* to cause stator S1 to vibrate as previously described and to drive rotor R1 in rotation. Such displacement in rotation of rotor R1 in the rotation sense RO provokes the subsequent displacement of the date disc 4 via the engaging pins 24 meshing with teeth 5**.

When rotor R1 has effected a rotation of about 180° and one of the disjunctions **58*a* or 58*b* is present under blade 50, the latter falls away suddenly into one of the corresponding openings or disengagements 62*a*, 62*b* which in the first embodiment, suffices to open the electric detection circuit 68 since the electric contact between blade 50 and hub 22** is broken.

Such information is handled by the control arrangement Dc which instantaneously cuts energization of the motor in acting on the source AL.

The operation is substantially identical for the second embodiment, except that the detection circuit 68, which in the rest state, is normally closed when blade 50, under the action of the cam profile 56 of hub 22, comes into lateral contact with stud 70 is found open when blade 50 leaves such contact at the moment in which it falls into one of the disjunctions **58*a* or 58*b***.

Figure 6:
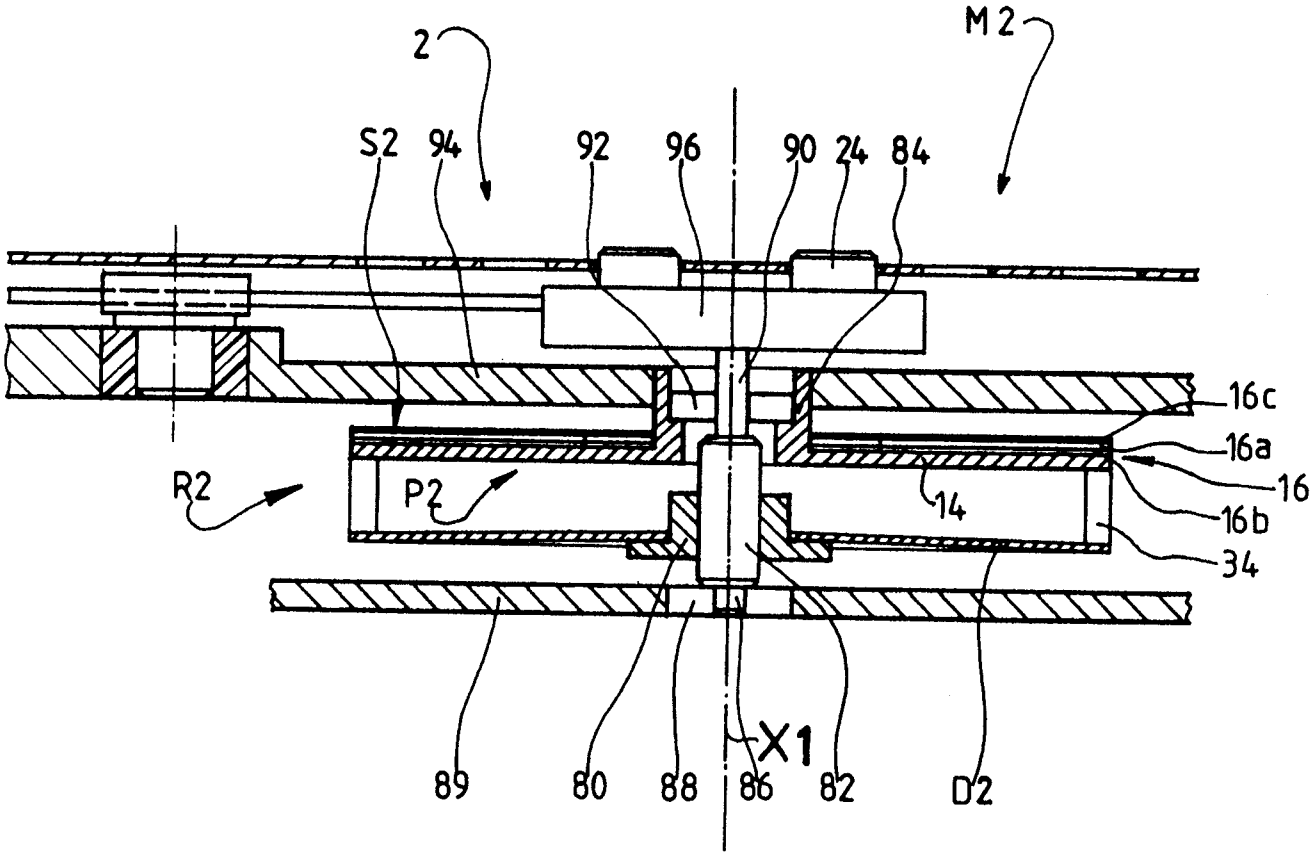
FIG. 6 is a cross-section view showing driving means according to a second embodiment of the invention.

Referring henceforward to FIG. 6 in which there have been used the same references as those of the preceding figures to identify elements analogous to those previously described, there will henceforward be described a second embodiment of the motor according to the invention, referenced generally by M2.

Motor M2 includes a stator S2 which is provided with the piezo-electric element 16 and the annular disc 14 described hereinbefore. On such stator S2 is assembled a rotor R2 the body of which is identical to rotor R1 including a flexible perforated disc D2 of the same structure as disc D1.

Rotor R2 is different in that it includes a staged hub 80 driven onto a driving spindle 82 traversing stator S2 through a pipe 84 materially integral with disc 14 of the suspended plate P2.

Hub 80 serves only to support the flexible perforated disc D2 in order to maintain it urged as shown on FIG. 6 under elastic stress towards plate P2 of stator S2.

The driving spindle 82 is assembled by a first guide-means 86 formed by a pivot (same reference) mounted for rotation in a bearing 88 formed, in this example, by a stone driven into a second support 89 formed by a base plate or by a bridge of the timepiece 1 (here shown partially).

Such spindle 82 is supported in rotation by a second guide means 90 constituted by a cylindrical journal (same reference) arranged on spindle 82 and mounted for rotation in a bearing 92 likewise formed by a stone which is driven into a cavity (not referenced) provided in pipe 84. It will be noted that pipe 84 itself is driven into a base plate or a bridge 94 which forms the support of stator S2.

It will be otherwise specified that the driving spindle 82 which is fixed in rotation to the body of rotor R2 via hub 80 in order to assure its centering around axis X1 is assembled for rotation at least within support 94 which it traverses in order to project outwardly therefrom and to cooperate with the mechanical engaging pins 24.

Stator S2 shows by way of example the same vibration modes as those previously described, motors M1 and M2 showing by way of example the same dimensions.

It is understood from what has just been described that there has been furnished self-blocking driving means thanks to the permanent pre-stressed state of the rotor of motors M1 and M2. Additionally, thanks to the arrangement of pins 24, the disc is fixedly maintained during the rest state of the piezo-electric motor according to the invention.

What I claim is:

1. A timepiece of the type comprising:

display means including an annular disc carrying time information thereon and having interior toothing for driving said annular disc, and driving means including a piezo-electric motor having a rotor and a stator, said rotor engaging directly with said interior toothing.

2. A timepiece as set forth in claim 1, wherein said piezo-electric motor includes angular indexing means integrated with said rotor and adapted to stop the rotational movement of the rotor in at least one predetermined angular position.

3. A timepiece as set forth in claim 2, wherein said indexing means include a rigid hub which exhibits a cam profile on which an elastic contact blade is brought to rest laterally.

4. A timepiece as set forth in claim 3, wherein said blade cooperates with an electric position detection circuit which it opens at a predetermined angular position of the rotor.

5. A timepiece as set forth in claim 4, wherein said blade is mounted on a support driven into a base plate or a bridge with interposition of an electric insulator.

6. A timepiece as set forth in claim 1, said driving means including two pins extending axially and cooperating with radial notches arranged in said annular disc.

7. A timepiece as set forth in claim 1, wherein said rotor comprises a perforated flexible disc.

8. A timepiece as set forth in claim 7, wherein the disc forming said rotor includes flexible arms which elastically couple a central portion of the rotor to a peripheral ring arranged about the latter, onto which motor transmission means are fitted.

9. A timepiece as set forth in claim 8, wherein the transmission means, which are formed by flexible blades, extend from the peripheral ring towards the motor stator, the flexible arms, said central portion and said peripheral ring being materially integral.

10. A timepiece as set forth in claim 7, wherein the rotor includes a driving spindle which is fixed for rotation to said perforated flexible disc and which assures its centering, said spindle being assembled to rotate at least within a support which it traverses so as to project outwardly therefrom and in order to cooperate with mechanical coupling means, such support being formed by a bridge or base plate.

11. A timepiece of the type comprising:

display means; and, driving means for driving said display means, said driving means comprising a piezo-electric motor directly engaging said display means, said piezo-electric motor comprising a stator and a rotor and including an angular indexing means integrated with said rotor to stop rotational movement of said rotor in at least one predetermined position.

12. A timepiece as set forth in claim 11, wherein said indexing means includes a rigid hub which exhibits a cam profile on which an elastic contact blade is brought to rest laterally.

13. A timepiece as set forth in claim 12, wherein said blade cooperates with an electric position detection circuit which it opens at a predetermined angular position of the rotor.

14. A timepiece as set forth in claim 13, wherein said blade is mounted on a support driven into a base plate or a bridge with interposition of an electric insulator.

15. A timepiece as set forth in claim 11, said driving means including two pins extending axially and cooperating with radial notches arranged in said annular disc.

16. A timepiece as set forth in claim 11, wherein said rotor comprises a perforated flexible disc.

17. A timepiece as set forth in claim 16, wherein the disc forming said rotor includes flexible arms which elastically couple a central portion of the rotor to a peripheral ring arranged about the latter, onto which motor transmission means are fitted.

18. A timepiece as set forth in claim 17, wherein the transmission means, which are formed by flexible blades, extend from the peripheral ring towards the motor stator, the flexible arms, said central portion and said peripheral ring being materially integral.

19. A timepiece as set forth in claim 16, wherein the rotor includes a driving spindle which is fixed for rotation to said perforated flexible disc and which assures its centering, said spindle being assembled to rotate at least within a support which it traverses so as to project outwardly therefrom and in order to cooperate with mechanical coupling means, such support being formed by a bridge or base plate.

* * * * *